United States Patent [19]

Balaban

[11] 4,249,732

[45] Feb. 10, 1981

[54] STRING PRE-STRETCHING APPARATUS AND METHOD FOR RACKET STRINGING MACHINE

[76] Inventor: John A. Balaban, 4142 Graham St., Pleasanton, Calif. 94566

[21] Appl. No.: 11,145

[22] Filed: Feb. 12, 1979

[51] Int. Cl.[3] ..... A63B 51/16

[52] U.S. Cl. ..... 273/73 A

[58] Field of Search ..... 273/73 A, 73 B, 73 D, 273/73 E; 73/145; 57/234, 243, 282, 283, 310

[56] References Cited

U.S. PATENT DOCUMENTS

| | | | |
|---|---|---|---|
| 1,545,314 | 7/1925 | Gower et al. | 273/73 A |
| 2,118,164 | 5/1938 | Chittenden et al. | 57/234 X |
| 2,154,870 | 4/1939 | Serrano | 273/73 A |
| 2,278,888 | 4/1942 | Lewis | 57/310 X |
| 2,861,417 | 11/1958 | Crandall | 57/310 X |
| 2,971,760 | 2/1961 | Boykin et al. | 273/73 A |
| 3,441,275 | 4/1969 | Held | 273/73 A |
| 3,469,001 | 9/1969 | Keefe | 57/243 X |
| 3,635,080 | 1/1972 | Krueger et al. | 273/73 AX |
| 3,775,960 | 12/1973 | Ogawa et al. | 57/310 X |
| 3,964,291 | 6/1976 | Ogden | 273/73 AX |
| 3,994,495 | 11/1976 | Stoffel | 273/73 AX |
| 4,029,317 | 6/1977 | Malmstrom | 273/73 DX |
| 4,140,316 | 2/1979 | Coupar | 273/73 DX |
| 4,156,525 | 5/1979 | Parnell | 273/73 A |
| 4,168,603 | 9/1979 | Reich et al. | 57/310 X |
| 4,168,606 | 9/1979 | Callander | 57/282 X |
| 4,183,200 | 1/1980 | Bajaj | 57/234 |

FOREIGN PATENT DOCUMENTS

| | | | |
|---|---|---|---|
| 314595 | 7/1929 | United Kingdom | 273/73 A |
| 402593 | 12/1933 | United Kingdom | 273/73 A |

*Primary Examiner*—Richard J. Apley

*Attorney, Agent, or Firm*—Warren, Chickering & Grunewald

[57] ABSTRACT

A racket stringing machine having a racket head holding fixture and a carriage and string clamp mounted for reciprocation toward and away from the fixture for engaging a string drawn through a racket head mounted on the fixture for tensioning of the string upon movement of the carriage away from the fixture; a brake for locking the position of the carriage relative to the fixture for maintaining the string at a predetermined tension, the carriage and brake being constructed to permit additional movement of the carriage away from the fixture for applying additional tension to and pre-stretching of the string; and means functioning on decrease of string tension to the desired predetermined tension to apply the brake.

5 Claims, 3 Drawing Figures

STRING PRE-STRETCHING APPARATUS AND METHOD FOR RACKET STRINGING MACHINE

BACKGROUND OF THE INVENTION

The invention relates to machines used for stringing of tennis rackets and the like and particularly to those machines which incorporate structure designed to assist in the obtaining of the desired objective of a uniform tensioning of the strings. U.S. Pat. No. 3,441,275 discloses a machine in which the string is tensioned by manual rotation of a crank causing displacement of a carriage and string clamp away from a fixture holding the racket head and in which the carriage is automatically locked against displacement relative to the head when the string reaches a predetermined tension. U.S. Pat. No. 2,154,870 incorporates a friction clutch in the string tensioning structure so that only a predetermined degree of tension can be imparted to the string. Due, however, to the many factors involved such as varying friction between the engaged strings and racket head, subsequent stress relieving of the strings, and other factors, a variable, uncertain and random loss of string tension will result. Nor is the loss consistent, but will vary from string-to-string and between the longitudinal main strings and the cross strings. The amount of stress release cannot be precisely determined and will vary with size, quality and length of string used and the variable, random friction between contacting strings. Moreover, stress release will occur over a period of time so that the playing characteristics of a racket will change (deteriorate) with use. Accordingly, expert players have come to accept a required break-in period for a newly strung racket. However, even accepting a break-in period, the player cannot know in advance what the ultimate tension and playing characteristics of the racket will be. The above-noted inconsistency may vary anywhere from about ten to twenty pounds from string-to-string, even after the break-in period.

SUMMARY OF THE INVENTION

I have found that the above-noted disadvantages may be overcome by pre-stretching of the racket string over and above the amount which occurs on drawing the string to its desired predetermined tension and then returning the string to its predetermined tension. Pre-stretching minimizes the characteristics that allow the strings to settle or relieve stresses and lose tension with use and time. Use of the apparatus of the present invention has virtually eliminated the need for a break-in period for newly strung rackets. The racket is ready for use as it comes off of the stringing machine. Moreover, the rate of string tension loss due to playing stress and time is substantially reduced thereby maintaining good string tension over a much longer period of time and use.

Another object of the present invention is to provide the racket stringing machine of the character described which will produce a significantly more uniform tension string-to-string, provide an improved overall evenness of resilience, and improved accuracy of ball action and control.

A further object of the present invention is to provide a racket stringing machine of the character above which will afford a heretofore unobtainable repeatability enabling a repeated stringing of a racket to a much more precise string tension assuring the player in advance of what the final string tension will be.

Still another object of the present invention is to provide a structure of the character described which may be readily added to existing racket stringing machines.

The invention possesses other objects and features of advantage, some of which of the foregoing will be set forth in the following description of the preferred form of the invention which is illustrated in the drawings accompanying and forming part of this specification. It is to be understood, however, that variations in the showing made by the said drawings and description may be adopted within the scope of the invention as set forth in the claims.

DETAILED DESCRIPTION OF THE INVENTION

Figure 1:
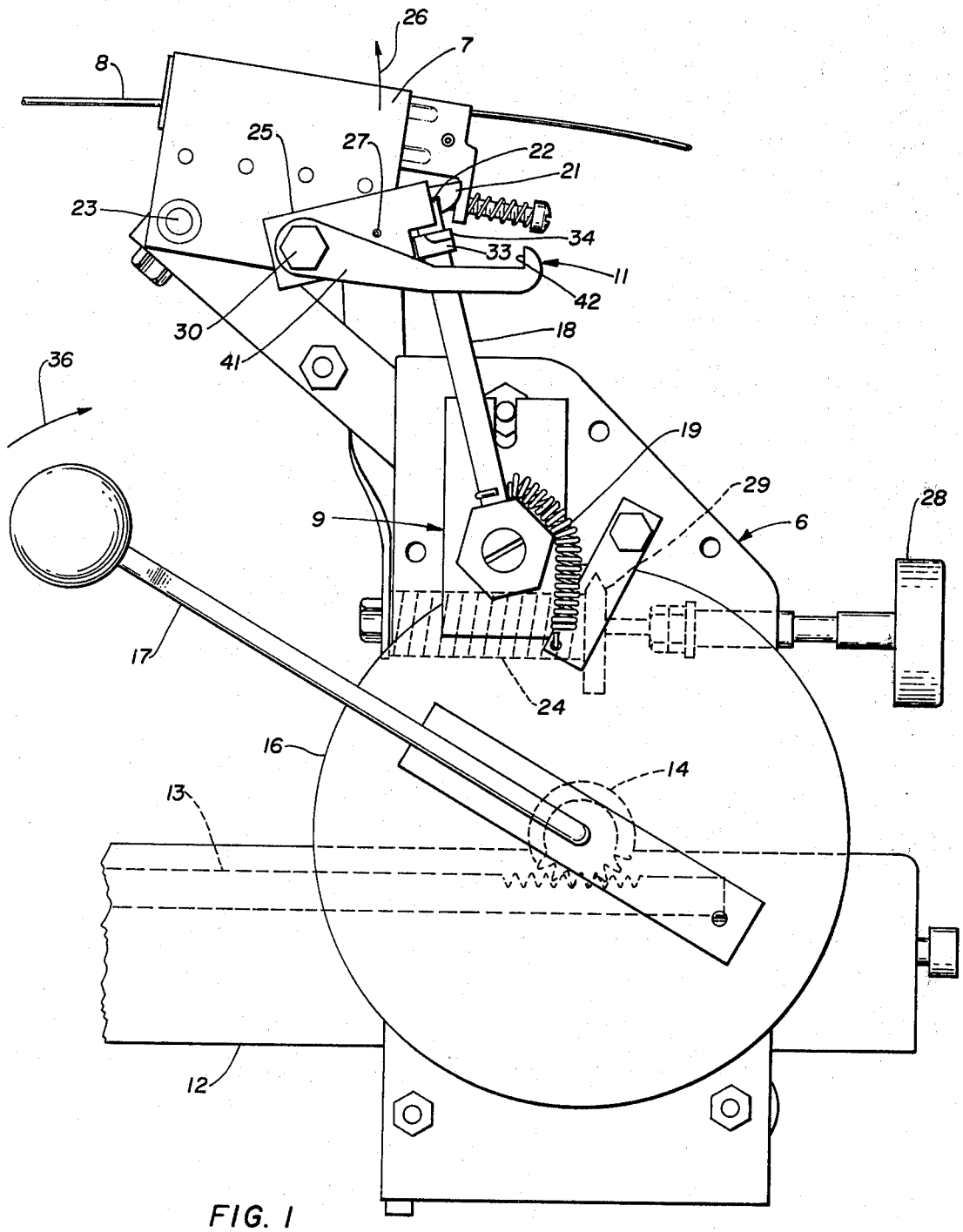
FIG. 1 is a side elevation of a racket pre-stretching apparatus for racket stringing machines constructed in accordance with the present invention.

The apparatus of the present invention is designed as an improvement to the racket stringing machine illustrated and described in U.S. Pat. No. 3,441,275 and the structure illustrated in the accompanying drawings is directed to that part of the machine which is subject to the present invention. Briefly, the racket stringing machine comprises a racket head holding fixture, see U.S. Pat. No. 3,441,275, and a carriage 6 mounted for reciprocation toward and away from the head fixture and a string clamp 7 mounted on the carriage for engaging a string 8 drawn through a racket head mounted on the fixture for tensioning the string upon movement of the carriage away from the fixture, e.g. to the right as seen in the drawings; a brake 9 for locking the position of the carriage relative to the fixture for maintaining the string in a predetermined tension and means 11 functioning on decrease of string tension to a predetermined tension to apply the brake. Machines constructed generally in accordance with U.S. Pat. No. 3,441,275 are sold under the trademark EKTELON manufactured by EKTELON in San Diego, Calif. and reference is made to the aforementioned patent and the EKTELON machine for further details of the carriage, string clamp and brake construction. As here illustrated, the carriage is mounted for reciprocation on an arm 12 extending laterally from the racket head holding fixture and which carries a rack 13 which is engaged by a pinion 14 on the carriage which, on rotation, causes the carriage to move on arm 12. Also mounted on carriage 6 concentrically with pinion 14 is a brake disc 16 to which a handle 17 is attached for manual rotation of the disc and pinion to cause reciprocation of the carriage, rotation of handle 17 in a clockwise direction, as viewed in the drawings, causing the carriage to move away from the head fixture, to the right, as seen in the drawings, to tension string 8, and movement of the handle in a counterclockwise direction causes the carriage to move toward the fixture thus reducing the tension of string 8. Of importance, insofar as the present invention is concerned, is the fact that brake 9 is operated by a brake arm 18 which is biased by spring 19 to move from a generally upright brake releasing position to a clockwise displaced brake setting position, as seen in phantom line in FIG. 3.

Figure 2:
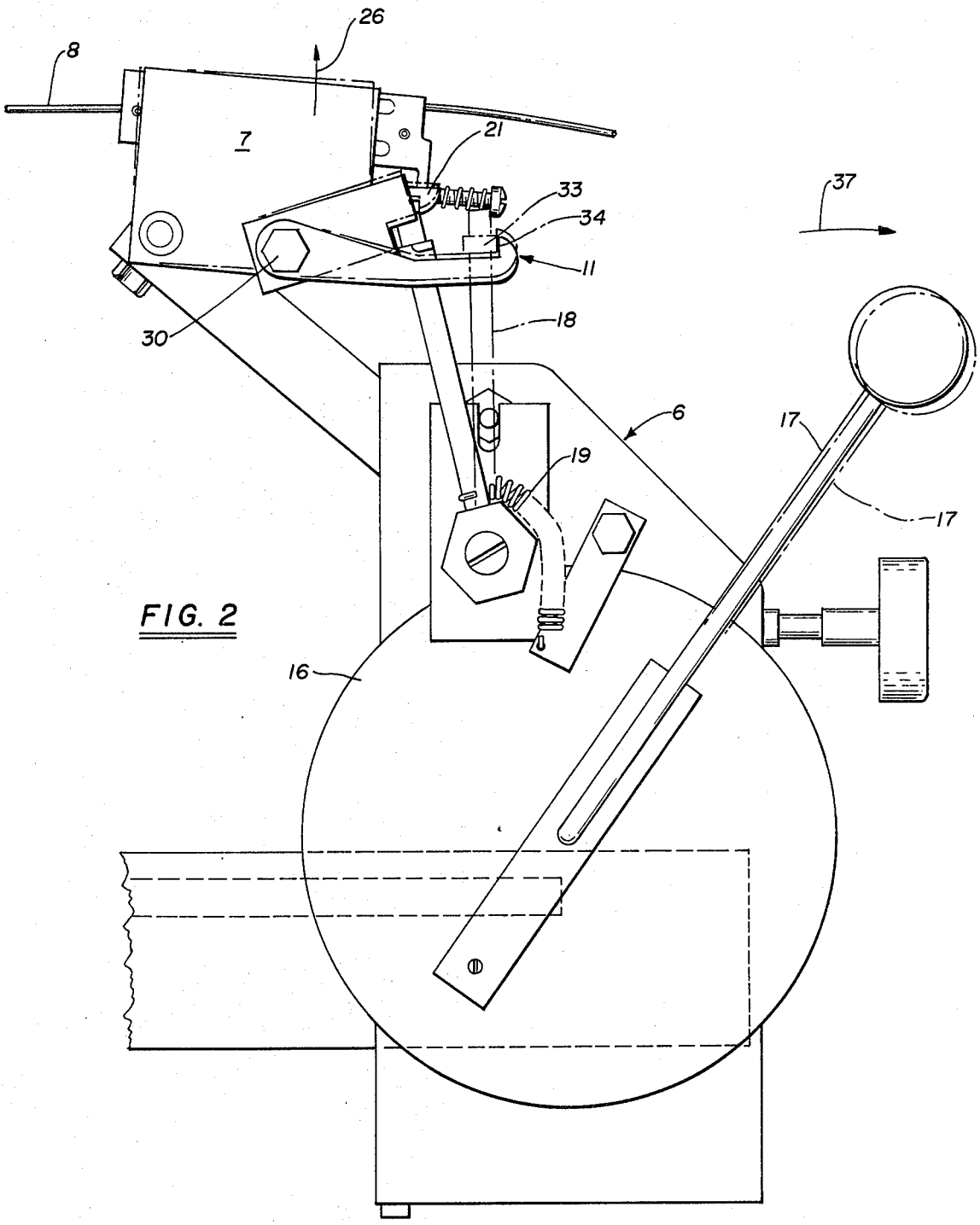
FIG. 2 is a side elevation similar to FIG. 1 but showing the parts in a different position.

Retention of brake arm 18 in its generally upright brake releasing position is effected by a detent 21 mounted on clamp 7 and engaging the upper end 22 of arm 18. Clamp 7 is itself pivotally mounted to carriage 6 by pivot pin 23 and is resiliently supported by spring 24 so that as the carriage is moved away from the head fixture to tension string 8, clamp 7 will rock in a counterclockwise direction, as indicated by arrow 26, to lift detent 21 from the upper end 22 of arm 18, thus releasing the arm to swing under the urge of spring 19 to brake setting position. This action occurs in the standard EKTELON machine when the string is drawn to a predetermined tension, and adjustment of this tension may be effected by a manually engageable knob 28 controlling the tension of spring 24, and the setting is shown on an indicator 29. As will be observed from the drawing, detent 21 is pivoted for rotation in housing 25 about a pivot pin 27; and housing 25 is itself fastened by a bolt 30 to one side of clamp 7 permitting arcuate adjustment of the housing and detent 21. Accordingly, and in accordance with the present invention, bolt 30 is loosened to permit a small clockwise displacement of housing 25 and then tightened to fix the position of detent 21 to cause release of arm 18 only after the carriage has been moved to attain not only the amount of desired string tension, as shown by indicator 29, but also a predetermined designated pre-stretching of string 8 beyond such predetermined tension. For example, I have found that such super-added pre-stretching of the string represented by an additional tensioning in the order of about 15 pounds pull is highly satisfactory. Accordingly, if indicator 29 is adjusted by knob to show a tensioning of say 40 pounds pull, detent 21 will release arm 18 as the pull on string 8 increases to 55 pounds. The term tension, as used herein, is defined and expressed as pounds pull on the string. As the limit of pre-stretching is reached, detent 21 will release arm 18 for movement automatically under the urge of spring 19 toward brake setting position. However, in accordance with the present invention, means 11 here in the form of a second detent is mounted on clamp 7 in position to intercept arm 18 when released by detent 21 thus retaining the arm in brake-releasing position; and the structure and mounting of detent 11 is such that it is responsive on decreasing string tension, see FIG. 3, on return movement of the carriage toward the head fixture to release arm 18 as the desired predetermined final string tension is reached, thus permitting biased movement of arm 18 to brake setting position, as shown in phantom line in FIG. 3. As a feature of the present invention, arm 18 when released by detent 21 will impact detent 11 with an audible snap, see phantom line, FIG. 2, thus advising the operator that the desired pre-stretching of the string has been accomplished and the operator is to initiate the return movement of the carriage. On return movement of the carriage to decrease string tension, arm 18 will be released by detent 11 at the desired predetermined string tension, e.g. 40 pounds, as herein explained.

Figure 3:
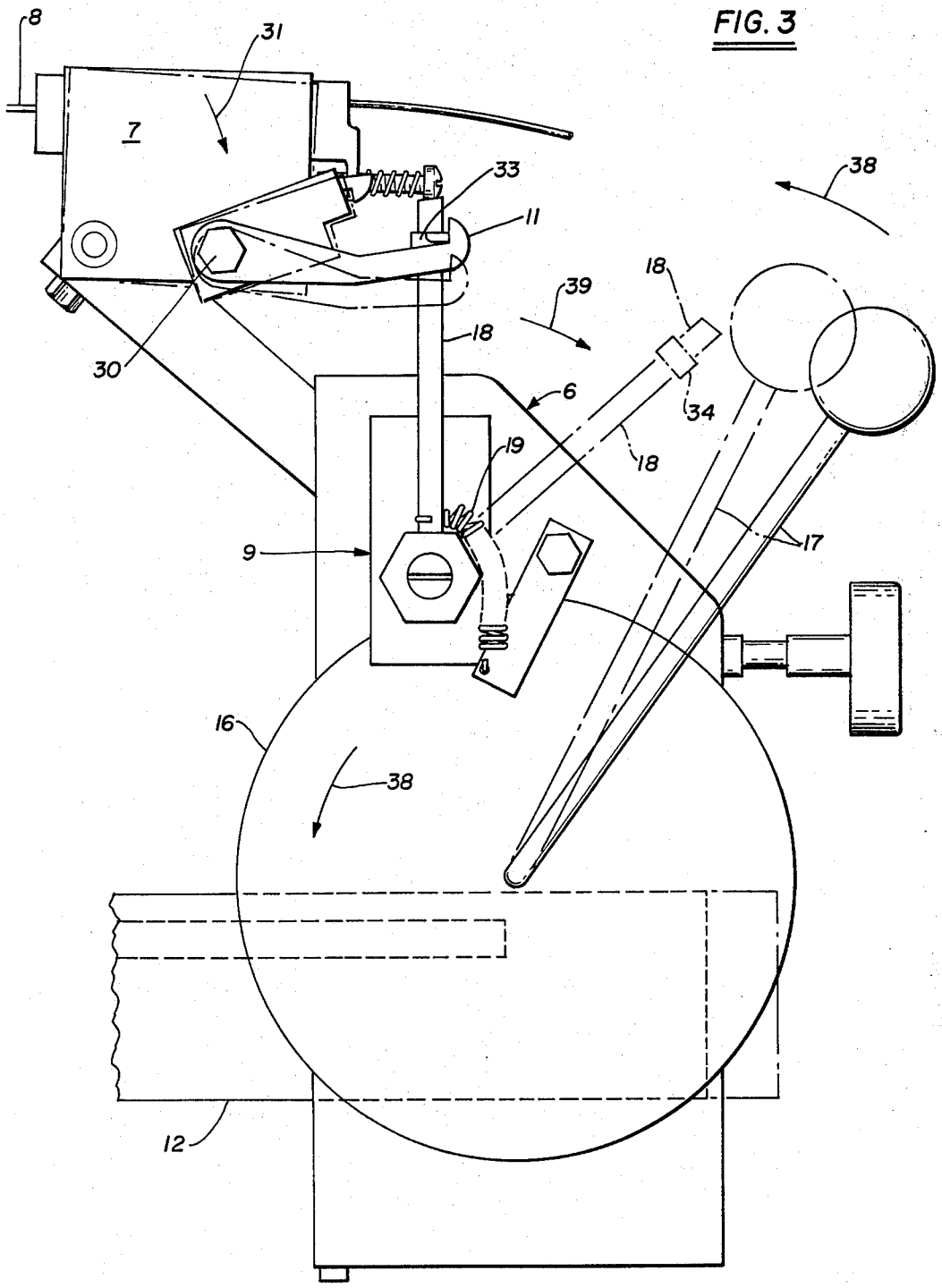
FIG. 3 is a side elevation similar to FIGS. 1 and 2 but showing the parts in a third position.

The foregoing operation is accomplished by causing release of arm 18 by detent 21 upon movement of clamp 7 in a counterclockwise direction, see arrow 26 in FIG. 1, on increasing string tension, and by releasing arm 18 from detent 11 upon subsequent movement of the clamp in a clockwise direction, as indicated by arrow 31 in FIG. 3. As will be observed from the drawings, a laterally extending bracket or keeper 33 is mounted on arm 18 adjacent its upper end 22 in position for engagement by detent 11 when arm 18 is released by detent 21, see phantom line in FIG. 2, it being noted that while detent 21 engages over the upper end of arm 18, detent 11 extends below keeper 33 and engages the leading upright side 34 of the keeper. Accordingly, the upper end 22 of arm 18 is released upon counterclockwise direction of clamp 7 while keeper 33 is released by detent 11 upon clockwise direction of the clamp.

Conversion of the standard EKTELON machine to a machine of the present invention requires only the addition of two parts, detent 11 which may be mounted on bolt 30 and keeper 33 which is mounted on arm 18. As will be noted, detent 11 is formed at one end of an arm 41 having its opposite end mounted on bolt 30, the length of arm 41 being such as to position detent 11 beyond detent 21 so as to intercept the arm as it is released by detent 21. The length of the detent face 42 engaged with keeper 33 will determine the point of release of the keeper upon clockwise movement of the detent on releasing string tension.

OPERATION

With the racket head mounted in the head holding fixture (not shown) and string 8 drawn through the string openings in the racket head and enaged in clamp 7, handle 17 is engaged and rotated in a clockwise direction as indicated by arrow 36 in FIG. 1, causing carriage 6 to move to the right, away from the fixture, on the rack and pinion connection 13 and 14, to tension string 8. Tensioning of string 8 is accompanied by a counterclockwise rocking of clamp 7, as indicated by arrow 26, and as a desired predetermined tension plus pre-stretch is reached, see phantom position of handle 17, detent 21 will lift off from the upper end of brake arm 18 releasing the latter to swing in a clockwise direction under the urge of spring 19 until keeper 33 strikes and is held by detent 11, see phantom position of arm 18, in FIG. 2. This release and action of arm 18 provides a visual and audible indication to the operator that the full pre-stretching step has been completed.

The interruption of movement of brake arm 18 retains the brake in its released position thus enabling the operator to start a return movement of the carriage. This action is best seen in FIG. 3 where handle 17 is shown in full lines displaced to its advanced position and its return movement is indicated in phantom line.

Upon completion of the pre-stretching step, as depicted in FIG. 3, handle 17 is swung in a return, counterclockwise direction, see arrows 38 in FIG. 3, thus decreasing the tension on string 8 and causing clamp 7 to rock in a clockwise direction, as indicated by arrow 31. As the predetermined final string tension is attained in the tension decreasing mode, detent 11 will move downwardly, as indicated in phantom line in FIG. 3 to release keeper 33, thus permitting brake arm 18 to abruptly swing clockwise, as indicated by arrow 39, to brake setting position. A string clamp is then placed at the racket head to hold the string tension in the head, string 8 released from clamp 7 and re-threaded through the racket head, the racket head fixture swung about to permit re-engagement of string 8 in clamp 7 for tensioning the next string in the racket head, all in accordance with standard racket stringing practice.

What is claimed is:

1. In a racket stringing machine having a racket head holding fixture and a carriage mounted for reciprocation toward and away from said fixture and a string clamp carried by said carriage for engaging a string drawn through a racket head mounted on said fixture and means for moving said carriage away from and toward said fixture for respectively increasing and decreasing the tension of said string;

a brake for locking the position of said carriage relative to said fixture for maintaining said string at a predetermined tension; and means functioning, on movement of said carriage from an advanced position of string tension substantially greater than said predetermined tension to a retracted position providing said predetermined tension, to apply said brake.

2. The structure of claim 1 and means indicating the attainment of a predetermined amount of pre-stretching of said string beyond said predetermined tension.

3. The structure of claim 2, said brake having a brake arm mounted on said carriage and movable between brake setting and brake releasing positions and being biased to brake setting position;

said second-named means comprising a first detent mounted on said carriage and holding said arm in brake releasing position and being responsive to said predetermined string tension and said predetermined pre-stretching of said string to release said arm;

said first-named means comprising a second detent mounted on said carriage in position to intercept said arm on release thereof by said first-named detent and retain said arm in brake releasing position; and said second detent being responsive to decreasing string tension on return movement of said carriage toward said fixture to release said arm at said predetermined tension for biased movement of said arm to brake setting position.

4. The structure of claim 3, said string clamp being pivotally mounted on said carriage for arcuate displacement in a first direction on increasing said string tension and in an opposite, second, direction upon decreasing string tension;

said first detent being mounted on said clamp and having a connection to said arm releasing said arm upon displacement of said clamp in said first direction; and said second detent being mounted on said clamp and having a connection to said arm releasing said arm upon displacement of said clamp in said second direction.

5. The method of setting to a predetermined tension a racket string mounted on a racket head across the interior opening thereof comprising, drawing said string across said racket head opening to a predetermined elevated tension substantially greater than said predetermined tension to effect a pre-stretching of said string to a length beyond its length at said predetermined tension;

decreasing the string tension to permit contraction of said string to said predetermined tension; and locking said string at said predetermined tension.

* * * * *